United States Patent [19]

Russo

[11] 4,377,075

[45] Mar. 22, 1983

[54] REFRIGERANT AND METHOD FOR SHIPPING PERISHABLE MATERIALS

[75] Inventor: Michael S. Russo, Brockton, Mass.

[73] Assignee: New England Nuclear Corporation, Boston, Mass.

[21] Appl. No.: 241,476

[22] Filed: Mar. 9, 1981

[51] Int. Cl.[3] ..... F25D 3/08

[52] U.S. Cl. ..... 62/372; 62/530

[58] Field of Search ..... 62/371, 372, 529, 530, 62/457

[56] References Cited

U.S. PATENT DOCUMENTS

| | | | |
|---|---|---|---|
| 1,731,578 | 10/1929 | Kennedy | 62/372 |
| 1,856,920 | 5/1932 | Lohner et al. | 62/372 |
| 2,467,268 | 4/1949 | Merkle | 62/372 |
| 2,631,439 | 3/1953 | Feigenbaum | 62/372 |
| 3,885,403 | 5/1975 | Spencer | 62/530 |
| 4,294,079 | 10/1981 | Benson | 62/372 |

*Primary Examiner*—Lloyd L. King

*Attorney, Agent, or Firm*—Sewall P. Bronstein; George W. Neuner

[57] ABSTRACT

A self-contained refrigerant package and method for shipment of a perishable or degradable product is described. The shipping package comprises an insulated container having therein a predetermined quantity of dry ice and a predetermined quantity of refrigerant gel that separates the product from the dry ice to prevent contact with the dry ice. The shipping package maintains the desired temperature range for periods in excess of 48 hours thus providing a safety factor for delays in shipment of such products.

4 Claims, 1 Drawing Figure

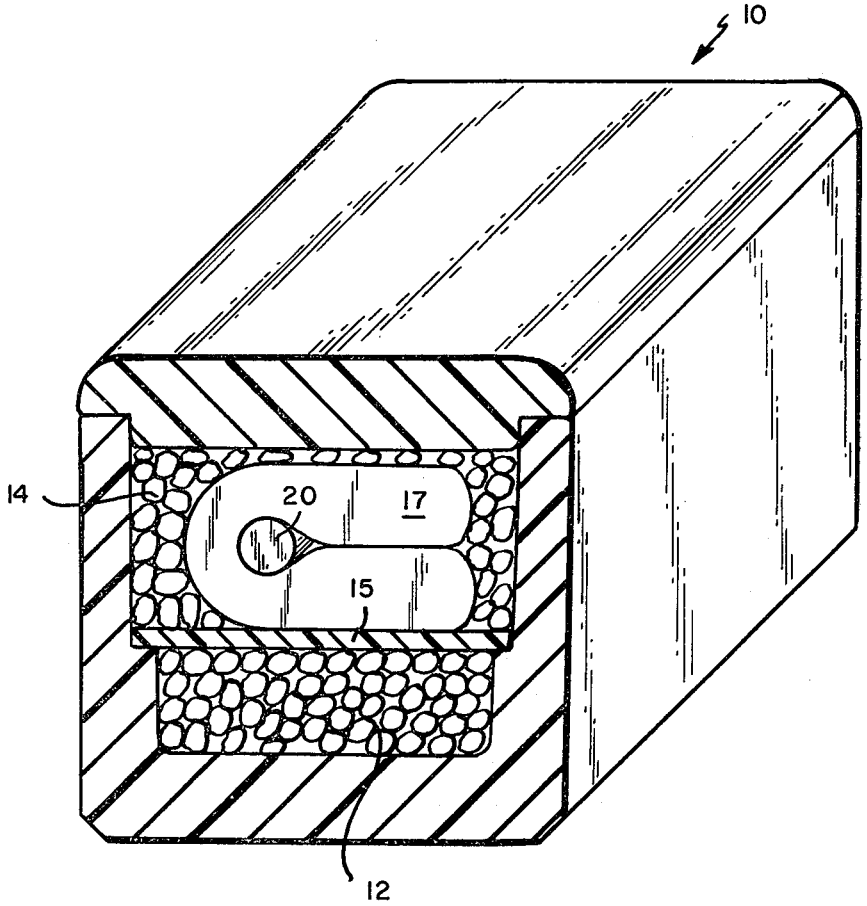
10
14
20
17
15
12

REFRIGERANT AND METHOD FOR SHIPPING PERISHABLE MATERIALS

FIELD OF THE INVENTION

The invention relates to refrigerants and methods for shipping perishable items and particularly to a dry refrigerant for safe transport of perishable or degradable items such as radiopharmaceuticals.

BACKGROUND OF THE INVENTION

Perishable items are now routinely shipped long distances in modern refrigerated vehicles. Although such shipping means work fine for bulk shipments or shipments that can be scheduled in advance to make use of such vehicles, they are not satisfactory for shipping small quantities of demand items that must be delivered within 24 to 48 hours.

At present a shipper who wants to send such demand items must generally use a self-contained refrigerant package. For a refrigerant he must choose between conventional "wet ice" and the reuseable gel-type refrigerant commonly known as "blue ice", or "dry ice" for materials that require or that can withstand very low temperatures. Each of the alternatives has disadvantages, particularly when shipping radiopharmaceuticals that cannot be cooled below −20° C. nor can the temperature be allowed to rise above 3° to 5° C. for periods of 36 or more hours that are at times encountered in transit. "Wet ice" is messy and leakage of the resulting water is possible, thus presenting a possible potential for involvement with goverment regulatory agencies because of the radioactive content of the package. "Blue ice" or refrigerant gel, typically a cellulose gel material in a polyethylene bag or other suitable container that is available commercially, generally provided the required cooling for only up to about 24 hours, which is not satisfactory. "Dry ice" is too cold providing a temperature below −20° C. and also is subject to regulatory problems if significant quantities are required.

Thus, a suitable economical refrigerant that is capable of providing a temperature in the range of from about −20° C. to about 5° C. for 36 or more hours is highly desirable.

SUMMARY OF THE INVENTION

The present invention provides a refrigerant package for shipping perishable items comprising an insulated container having a predetermined quantity of refrigerant gel and a predetermined quantity of dry ice, preferably separated from the refrigerant gel by a partition, wherein the item to be shipped is placed in contact with the refrigerant gel.

Surprisingly the use of both dry ice and refrigerant gel for a refrigerant package provides a refrigerated environment for the item to be shipped that is, in some instances, superior to a package using either the refrigerant gel or dry ice alone. For instance, a refrigerant package in accord with this invention comprising a ten pound insulated container made of styrofoam and containing three pounds of refrigerant gel and one pound of dry ice pellets provides a shipping environment that does not drop in temperature below −20° C. and remains below about 0° C. for at least 48 hours.

BRIEF DESCRIPTION OF THE DRAWINGS

The FIGURE is a cross-sectional view of a refrigerant package in accord with one embodiment of the present invention.

DESCRIPTION OF THE INVENTION

In accord with the present invention a dry self-contained refrigerated shipping package is provided for perishable or degradable items. In accord with one embodiment of the invention as illustrated in the FIGURE the package comprises an insulated container 10, preferably made of styrofoam. Inside the styrofoam container is a quantity of dry ice 12. Conveniently dry ice pellets are used in order to facilitate placing the desired quantity of dry ice in the container.

A separator 15 is preferably positioned between the dry ice 12 and a refrigerant gel pack 17. The separator is conveniently a piece of corrigated board (or cardboard) that separates and confines the dry ice and prevents it from contacting the gel pack to avoid any possible damage to the polyethylene container.

The gel pack 17 is placed above the separator and the material to be shipped is placed on the gel pack. Conveniently, the material 20 being shipped is sandwiched in the gel pack if such is feasible. In any event, the separator and/or gel pack are used to prevent the dry ice from contacting the material being shipped. The remaining space in the container is filled with a loose packing 14 such as styrofoam packing material to prevent movement inside the container during shipping.

The quantity of refrigerant gel and of dry ice depends upon the particular material being shipped, the lowest temperature that can be encountered, the temperature range that is required or desired, and the time period during which this temperature range must be kept. Indeed, a suitable ratio of gel to dry ice can be determined by a few simple tests wherein the inside temperature of the container is monitored over the required period of time.

For example, a three pound pack of refrigerant gel and one pound of dry ice pellets were placed in a ten pound styrofoam container as illustrated in the FIGURE. The temperature of the inside of the container was monitored and the results tabulated below.

TABLE 1

| Refrigerant Package Containing Three Pounds Refrigerant Gel and One Pound Dry Ice Pellets | |
|---|---|
| Time, hr | Temperature, °C. Inside Container |
| 0 | −5 |
| 1 | −12 |
| 2 | −14 |
| 3 | −16 |
| 4 | −18 |
| 5 | −18 |
| 6 | −18 |
| 7 | −18 |
| 8 | −18 |
| 24 | −3 |
| 25 | −3 |
| 26 | −3 |
| 27 | −3 |
| 28 | −3 |
| 29 | −2 |
| 30 | −2 |
| 31 | −2 |
| 32 | −1 |
| 48 | 0 |

TABLE 1-continued

| Refrigerant Package Containing Three Pounds Refrigerant Gel and One Pound Dry Ice Pellets | |
|---|---|
| Time, hr | Temperature, °C. Inside Container |
| 49 | 0 |

Thus, a ratio of refrigerant gel to dry ice pellets of about 3:1 by weight was found to provide an environment wherein the temperature did not drop below −18° C. and did not rise above 0° C. more than 48 hours. Therefore, even during an unforeseen delay in shipment, a material in the container that must be kept at a temperature below 3° to 5° C. would be safeguarded for more than 48 hours.

Other ratios of refrigerant gel to dry ice would likewise be effective for prolonging subzero temperatures inside the shipping container while preventing exposure of the material being shipped to dry ice temperature.

The invention has been described in detail with reference to the preferred embodiments thereof. However, it will be appreciated that those skilled in the art, upon reading this disclosure, may make modifications and improvements within the spirit and scope of the invention.

I claim:

1. A method for shipping a degradable product, said method comprising: placing a predetermined quantity of dry ice in the bottom of an insulated container; sandwiching said product in a predetermined quantity of refrigerant gel, placing the refrigerant gel and sandwiched product on top of the dry ice in such a manner that the dry ice does not contact the product, and sealing the insulated container to provide a self-contained refrigerated environment for the product that will not have a temperature lower than about −20° C. or higher than about 0° C. for 48 hours or more.

2. The method of claim 1 further comprising the step of placing a separator between the dry ice and the refrigerant gel to confine the dry ice to the lower portion of the container.

3. The method of claim 1 wherein said refrigerant gel and said dry ice are present in a ratio of about 3:1 by weight.

4. The method of claim 1 wherein said container is a styrofoam container.

* * * * *